United States Patent [19]

Sperry et al.

[11] 3,938,991

[45] Feb. 17, 1976

[54] REFINING RECRYSTALLIZED GRAIN SIZE IN ALUMINUM ALLOYS

[75] Inventors: Philip R. Sperry, North Haven, Conn.; William C. Setzer, Creve Coeur, Mo.

[73] Assignee: Swiss Aluminium Limited, Chippis, Switzerland

[22] Filed: July 15, 1974

[21] Appl. No.: 488,677

[52] U.S. Cl. ..... 75/143; 75/141; 75/142; 75/146; 75/147; 75/148; 148/2; 148/11.5 A; 148/32

[51] Int. Cl.[2] ..... C22C 21/14; C22F 1/04

[58] Field of Search ..... 75/148, 143, 147, 138, 75/142, 141, 146; 148/32, 32.5, 11.5 A, 2, 3, 13

[56] References Cited

UNITED STATES PATENTS 3,293,733 12/1966 Broverman et al. ..... 75/138

3,642,542 2/1972 Sperry et al. ..... 75/147

*Primary Examiner*—R. Dean

*Attorney, Agent, or Firm*—David A. Jackson; Robert H. Bachman

[57] ABSTRACT

A wrought article possessing a fine recrystallized grain size which is prepared from an aluminum base alloy comprising, in weight percent, up to .6% silicon, up to .7% iron, up 1.5% manganese and 0.03 – 0.20% vanadium. The alloy may be cast by the DC casting method and does not require a homogenizing treatment. The alloy may be hot and cold worked, and retains its fine grain through annealing without requiring a high rate of heating to annealing temperature.

18 Claims, 4 Drawing Figures

| FINAL ANNEALED GAUGE | ALLOY A | ALLOY B | ALLOY C |
|---|---|---|---|
| .060" (NO INTERANNEAL) |  |  |  |
| .040" (ONE INTERANNEAL) |  |  |  |
| .020" (ONE INTERANNEAL) |  |  |  |

REFINING RECRYSTALLIZED GRAIN SIZE IN ALUMINUM ALLOYS

BACKGROUND OF THE INVENTION

The present invention concerns the preparation of wrought products possessing a fine recrystallized grain size from certain aluminum base alloys.

Aluminum base alloys, particularly those of the 3000 Series, as designated by the Aluminum Association, which have been formed into various wrought products such as sheet, are difficult to process to a fine enough recrystallized grain size to avoid development of the condition known as "orange peel" when the alloy is subjected to various forming operations. One solution to this problem which has been developed in the art is the application of high rates of heating to the anneal temperature of the alloy to reduce the grain size of the anneal product. Such methods, however, are low in productivity as adequate fast heating can only be conducted on a small scale with conventional equipment, or costly specialized equipment would be required which is difficult to justify economically in comparison with large scale batch annealing of large coils.

An additional problem relating to grain size exists which is peculiar to alloys such as Alloy 3003. Initially these alloys were cast into ingots by methods which produced slow cooling during and after solidification, and little trouble was experienced with grain size when such ingots were rolled and annealed. However, upon the introduction of the more efficient DC casting process, it was discovered that an extended high temperature homogenizing heat treatment of the ingot was necessary in order to avoid coarse grain formation upon later annealing. The long furnace time required for this homogenizing is costly and it creates a manufacturing bottleneck. The aluminum industry has done much to determine the cause of this effect, but it has not succeeded in altering the basic requirement. Even then, grain size problems frequently arise to plague the metal producer, especially when preferred orientations which cause "earing" during deep drawing must also be controlled. It has, therefore, long been an industry-wide objective to shorten or eliminate the homogenization and to either lessen sensitivity to heating rate or find an economical means of producing high heating rate.

SUMMARY OF THE INVENTION

In accordance with this invention, wrought products are prepared from an aluminum base alloy which comprises, in weight percent, up to 0.6% silicon, preferably from about 0.03 – 0.6% silicon, up to 0.7% iron, preferably from about 0.03 – 0.7% iron, up to 1.5% manganese, preferably from about 0.03 – 1.5% manganese, about 0.03 – 0.20% vanadium, balance essentially aluminum.

The wrought products of this invention possess a fine recrystallized grain size and require neither a homogenizing treatment after casting nor an accelerated heating rate to annealing temperature. Correspondingly, the method of preparing the wrought products may employ the faster DC casting method without the need of subsequent homogenization, and an annealing treatment which employs reduced rate of heating to annealing temperature.

It is, accordingly, a principal object of the present invention to provide wrought products from aluminum base alloys which consistently exhibit a fine recrystallized grain size.

It is a further object of the present invention to provide wrought products as aforesaid which may be prepared by a process which employs DC casting but does not require homogenization.

It is yet a further object of the present invention to provide wrought products as aforesaid which may be annealed without a high rate of heating to annealing temperature.

It is a still further object of the present invention to provide wrought products which are prepared from an aluminum base alloy to which from about 0.03% – 0.20% by weight of vanadium is added.

Other objects and advantages will be apparent to one skilled in the art from a consideration of the description which follows.

DETAILED DESCRIPTION OF THE PREFERRED EMBODIMENTS

Figure 1A:
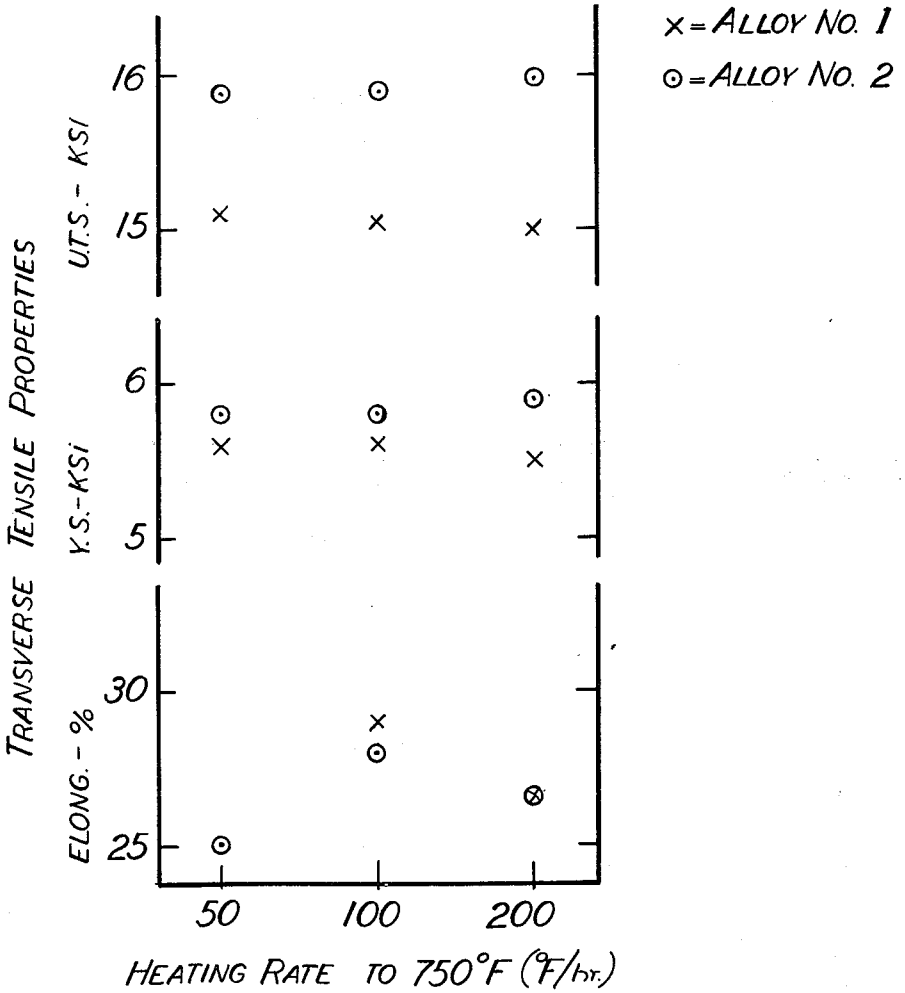
FIG. 1A is a graph of tensile properties measured from alloy samples heated at various rates to an annealing temperature of 750°F.

In accordance with the present invention, the foregoing objects and advantages are readily obtained. The wrought products of the present invention are prepared from an aluminum base alloy which comprises, in weight percent, up to 0.6% silicon, preferably from about 0.03 – 0.6% silicon, up to 0.7% iron, preferably from about 0.03 – 0.7% iron, up to 1.5% manganese, preferably from about 0.03 – 1.5% manganese, and 0.03 – 0.20% vanadium, balance essentially aluminum. The wrought products of this invention may be prepared by a process which comprises a DC casting operation requiring no subsequent homogenization and including an annealing step which employs a reduced rate of heating to annealing temperature, yet yields products possessing expectedly reduced recrystallized grain size. In a preferred embodiment, the alloy of this invention comprises, in weight percent, 0.10 – 0.20% silicon, 0.40 – 0.60% iron, 0.10 – 0.20% copper, 0.10 – 1.5% manganese, 0.005 – 0.02% titanium, and 0.03 – 0.12% vanadium. The aluminum base alloys processed in accordance with the present invention are those which are designated as the 3000 Series alloys by the Aluminum Association. In addition to the elements stated above, the alloys of the present invention may contain the following additives: copper up to 0.3%, magnesium up to 1.3%, chromium up to 0.25%, zinc up to 0.4%, titanium up to 0.2% and zirconium up to 0.17%. As a general rule, additives and other impurity elements may be present in amounts not adversely affecting the properties of the alloy.

As stated earlier, the alloys of this invention are prepared by the addition of from about 0.03% to about 0.20% by weight, of vanadium. It has surprisingly been found that the resulting alloys may be cast by the faster, more efficient DC casting method, and do not require subsequent homogenization to inhibit undesirable grain growth. The omission or shortening of the homogenizing treatment has long been an industry objective.

The alloys of this invention have also been found to exhibit an unexpectedly fine recrystallized grain size after annealing without the requirement of an accelerated rate of heating to annealing temperature. Thus, for example, heating rates such as 50°F/hour or less may be employed to reach annealing temperature, rather than faster rates up to 20,000°F/hour which may be employed to inhibit recrystallized grain growth.

Aside from the differences in processing noted above, the alloys of this invention may be treated in accordance with conventional techniques. Thus, the alloys may be hot worked, such as by hot rolling, at temperatures, such as for example, 900°F, and may be cold worked as, for example, by cold rolling to reductions of, for example, 50% or greater. Such processing may be conducted in a manner well known to those skilled in the art, and need not be further discussed herein.

In addition to the unexpected ease of processing, the alloys of this invention possess improved tensile properties and exhibit other properties, such as ductility, which are comparable to acceptable levels achieved by conventional alloys. Also, conductivity measurements show that much or all of the vanadium present in the alloys of this invention is retained in solid solution in the final annealed condition, as the conductivity of the vanadium containing alloys was found to be consistently less than that of alloys which contained no vanadium.

The present invention will become more readily apparent from the following illustrative examples.

EXAMPLE I

The purpose of this example was to compare a standard aluminum base alloy of the 3000 Series which had been homogenized in the conventional manner, with a similar alloy containing 0.1% vanadium which was exposed to an abbreviated industrial homogenizing. Accordingly, two alloys were Durville cast in the usual manner which possessed the compositions set forth in Table I, below.

TABLE I

| | COMPOSITION (WEIGHT %) | | | | | | |
|---|---|---|---|---|---|---|---|
| Alloy Number | Si | Fe | Cu | Mn | Ti | V | Al |
| 1 | .10 | .53 | .10 | 1.15 | .014 | — | Bal. |
| 2 | .12 | .52 | .10 | 1.18 | .011 | .092 | Bal. |

Both alloys were subjected to homogenization. Alloy 1 was heated at a rate of 50°F/hour from a temperature of 600°F to 1125°F. The alloy was held at this temperature for 8 hours and then air cooled at a rate of 50°F/hour to a temperature of 1025°F.

Alloy 2 was heated at a rate of 50°F to 1100°F. The alloy was held at this temperature for 4 hours and was then air cooled.

Both homogenized ingots were hot rolled at 900°F to a thickness of 0.160 inch, and were then cold rolled to a thickness of 0.040 inch with an intermediate annealing treatment at 0.080 inch of 750°F for three hours. Annealing temperature was reached from a starting temperature of 300°F at a heating rate of 50°F/hour. The alloys were finally annealed at a temperature of 750°F for a period of three hours, and samples were heated to annealing temperature at heating rates of 50°, 100° and 200°F/hour, respectively. The resulting alloy samples were then tested for tensile properties and grain size was observed and measured. The results are set forth in FIGS. 1A and 1B.

Figure 1B:
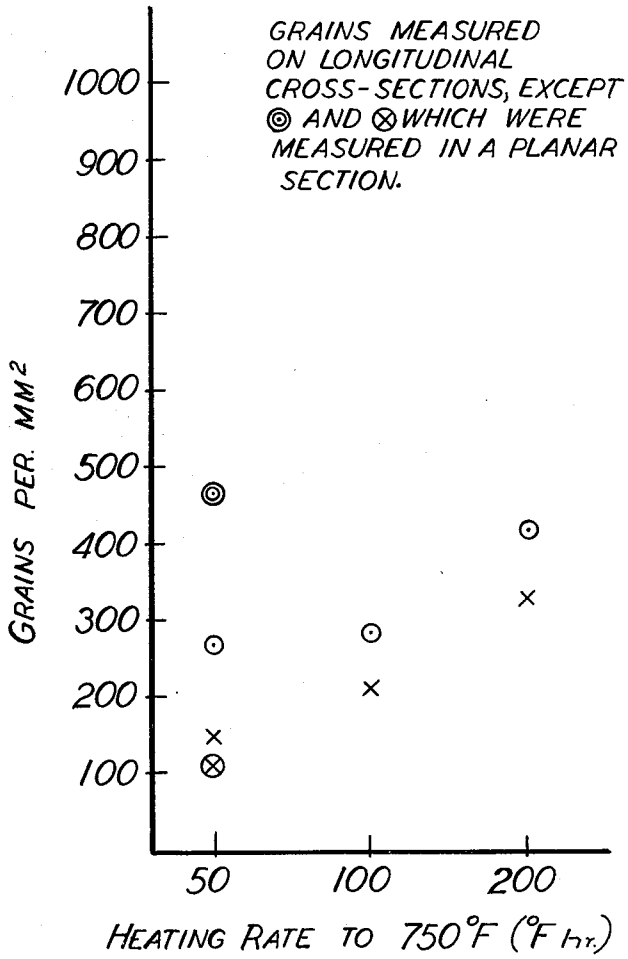
FIG. 1B is a graph of the number of grains/square mm. observed and counted in the samples of FIG. 1A.

Referring to FIG. 1A, it can be seen that Alloy No. 2 which is representative of the invention, exhibits consistently higher yield strength and tensile strength while maintaining a level of ductility comparable to that of Alloy 1, the latter as evidenced by the elongation data. As can be seen from FIG. 1B, Alloy No. 2 exhibited a consistently finer grain size at all heating rates, and most particularly at the economically desirable heating rate of 50°F/hour.

EXAMPLE II

In this experiment, alloy samples were obtained from ingots which were prepared by the DC casting method in order to determine if the grain refining effect of vanadium observed in Example I, above, would be present in the use of a faster casting method. Accordingly, three alloys were prepared and cast by the DC casting method which possessed compositions set forth in Table II, below.

TABLE II

| | COMPOSITION (WEIGHT %) | | | | | | |
|---|---|---|---|---|---|---|---|
| Alloy Number | Si | Fe | Cu | Mn | Ti | V | Al |
| A | .215 | .60 | .16 | 1.00 | .008 | >.01 | Bal. |
| B | .20 | .59 | .15 | 1.08 | .0096 | .033 | Bal. |
| C | .20 | .59 | .14 | 1.07 | .010 | .11 | Bal. |

The alloys were cast at various temperatures and rates. Thus, Alloy A was cast at a temperature of 1300°F at a drop rate of 4.5 – 5 inches/minute, Alloy B was cast at 1310°F at a drop rate of 4 inches/minute, and Alloy C, at 1305°F and a drop rate of 4 inches/minute.

Other conditions such as mold size, metal head, cooling water rate and charge weight were identical for all of the alloys cast. The uable length of the resulting ingots was in excess of 40 inches.

Each of the three ingots prepared above was divided into sections which were processed through hot rolling in different ways. The first sections were homogenized by heating at a rate of 50°F/hour to a temperature of 1125°F and were then maintained at that temperature for 8 hours. The sections were air cooled at a rate of 50°F/hour to a temperature of 1025°F, and were then scalped and reheated to be hot rolled at 850°F from a thickness of 2.6 inches down to either 0.250 inch or 0.160 inch.

The second sections were heated to 1100°F at a rate of 50°F/hour, held at that temperature for 4 hours and then air cooled. The sections were then scalped and reheated to 900°F for hot rolling in the same manner as the first sections.

The samples were cold rolled and annealed in accordance with three different sequences to produce final gauges of 0.060 inch, 0.040 inch and 0.020 inch, respectively. The first gauge was reached by taking samples which had been hot rolled to 0.160 inch, cold rolling them to 0.060 inch and then annealing them. The second gauge was reached by starting with samples of 0.250 inch hot rolled gauge, cold rolling to 0.114 inch, annealing, cold rolling again to 0.040 inch and finally annealing. The third final annealed gauge was prepared by cold rolling samples at 0.160 inch gauge to a thickness of 0.067 inch, annealing, then cold rolling 0.020 inch and conducting a final anneal.

All of the anneals conducted above, both intermediate and final, followed the same sequence. The samples were heated from a temperature of 300°F to 660°F at a rate of 25°F/hour and held at that temperature for 2.5 hours. The samples were then furnace cooled to 400°F at a rate never in excess of 50°F/hour and finally air cooled. This heating rate is very slow but represents what may be expected in the batch annealing of large coils.

Figure 2A:
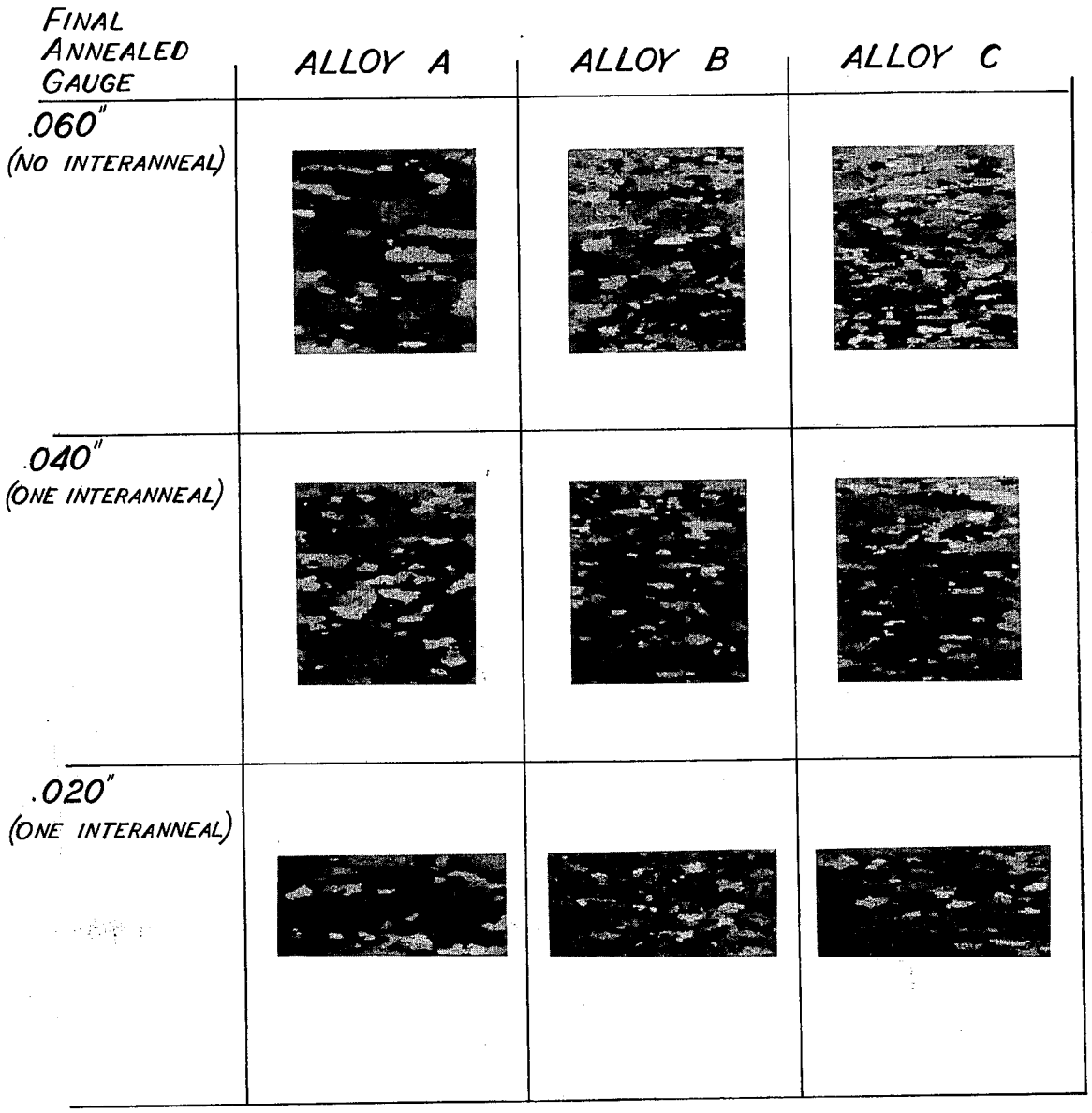
FIGS. 2A and 2B are charts comprising photomicrographs of alloy samples containing various amounts of vanadium subjected to various annealing treatments, and represent respectively, results due to a full and an abbreviated homogenizing treatment.
Figure 2B:
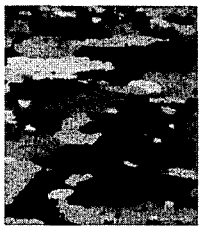
Figure 2B:
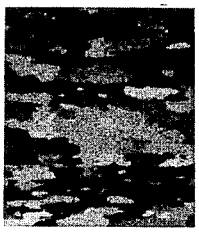
Figure 2B:
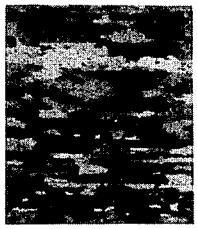
Figure 2B:
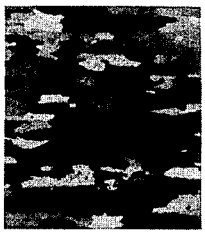
Figure 2B:
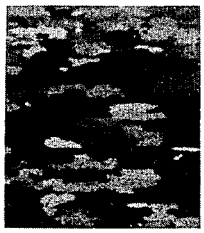
Figure 2B:
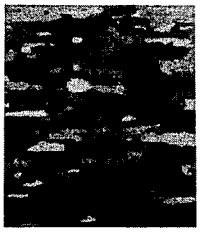
Figure 2B:
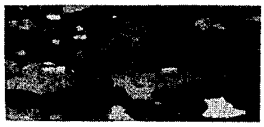
Figure 2B:
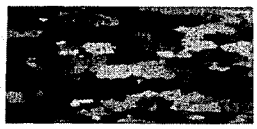
Figure 2B:
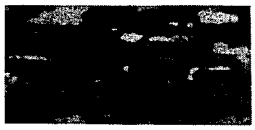

The samples thus prepared were then examined for visible differences in grain size and photographs illustrating these differences are presented in accompanying FIGS. 2A and 2B.

Referring to the Figures, it is initially apparent from FIG. 2B that, regardless of the extent of cold rolling and annealing, the samples of Alloy A which contained no vanadium exhibited an intolerably coarse grain size after an abbreviated homogenizing treatment, whereas those samples which were exposed to the conventional extended homogenization shown in FIG. 2A, possessed a more refined grain size. What is noteworthy is that the samples containing vanadium, represented by Alloys B and C in FIG. 2B, which were given a brief homogenization, possessed a fine grain size comparable to that of the Alloy A samples in FIG. 2A, and clearly superior to the coarse-grained samples of FIGS. 2B. Correspondingly, the samples of Alloy B and C shown in FIG. 2A, which were given a full homogenization, possessed a more refined grain size which was clearly distinguishable from the comparative samples of Alloy A depicted therein.

In addition to grain size investigation, the samples were tested for longitudinal and transverse tensile properties, and conductivity. The results of these tests are presented in Table III, below.

brief homogenizing on tensile properties is evident from the comparison of strengths which was made with all alloy samples.

The elongation data suggests, as observed in Example I, that the ductility of the vanadium-containing alloys was comparable to that of conventionally prepared alloys. Conductivity measurements disclose that the alloys which contain vanadium exhibit consistently much lower conductivity than those that do not. As a significant lowering in conductivity of an alloy generally accompanies the entry of one or more of its elements into solid solution, it is concluded that the vanadium additions of the alloys of this invention reside in solid solution.

The alloys of this invention permit the large scale employment of economically advantageous processing without the sacrifice of formability of the alloy. Thus, the expensive homogenizing treatment can be all but eliminated, and heating rates to annealing temperature can be greatly reduced so as, for example, to enable the batch annealing of large coils.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An aluminum base alloy possessing a fine recrystallized grain size in the annealed condition which consists of 0.03 – 0.6% silicon, 0.03 – 0.7% iron, 0.03 – 1.5% manganese, 0.03 – 0.20% vanadium, up to 0.3% copper, up to 0.2% titanium, balance aluminum.

2. The alloy of claim 1 wherein said vanadium is retained in solid solution.

3. The alloy of claim 1 comprising about 0.10 – 0.20% silicon, about 0.40 – 0.60% iron, about 0.10 – 0.20% copper, about 0.10 – 1.5% manganese, about 0.005 – 0.02% titanium and 0.03 – 0.12% vanadium.

4. The alloy of claim 1 wherein said alloy is in the annealed condition.

5. The alloy of claim 1 wherein said alloy is in the annealed and cold worked condition.

6. A wrought article possessing a fine recrystallized grain size prepared from an aluminum base alloy con-

TABLE III

| ALLOY NUMBER | FINAL ANNEALED GAUGE | HOMOGENIZATION | LONGITUDINAL TENSILE Y.S. (ksi) | LONGITUDINAL TENSILE U.T.S. (ksi) | LONGITUDINAL TENSILE % ELONGATION | TRANSVERSE TENSILE Y.S. (ksi) | TRANSVERSE TENSILE U.T.S. (ksi) | TRANSVERSE TENSILE % ELONGATION | CONDUCTIVITY (% IACS) |
|---|---|---|---|---|---|---|---|---|---|
| A | 0.060" | FULL | 6.9 | 15.9 | 33.3 | 6.3 | 14.7 | 30.3 | 47.0 |
| | | BRIEF | 6.9 | 16.4 | 32.0 | 6.6 | 15.7 | — | 49.0 |
| | 0.040" | FULL | 7.1 | 15.9 | 30.8 | 6.8 | 14.8 | 28.3 | 47.4 |
| | | BRIEF | 7.1 | 16.2 | 30.0 | 6.3 | 15.5 | 27.5 | 49.0 |
| | 0.020" | FULL | 7.5 | 16.0 | 30.0 | 6.4 | 14.6 | 27.5 | 47.8 |
| | | BRIEF | 7.7 | 16.4 | 29.0 | 5.8 | 15.0 | 22.5 | 49.5 |
| B | 0.060" | FULL | 7.3 | 16.7 | 33.3 | 7.1 | 15.6 | 30.8 | 45.5 |
| | | BRIEF | 7.4 | 17.1 | 31.5 | 6.6 | 15.9 | 22.3 | 47.2 |
| | 0.040" | FULL | 7.1 | 16.3 | 31.3 | 7.4 | 15.2 | 30.0 | 46.0 |
| | | BRIEF | 7.5 | 17.1 | 30.0 | 6.3 | 15.8 | 29.3 | 47.5 |
| | 0.020" | FULL | 7.2 | 16.6 | 29.8 | 6.7 | 15.2 | 27.8 | 46.0 |
| | | BRIEF | 7.7 | 17.1 | 29.0 | 6.3 | 15.8 | 29.3 | 48.0 |
| C | 0.060" | FULL | 7.4 | 17.3 | 31.0 | 7.0 | 16.5 | 30.8 | 42.7 |
| | | BRIEF | 7.8 | 17.9 | 30.8 | 7.0 | 16.7 | 31.5 | 45.0 |
| | 0.040" | FULL | 7.5 | 17.2 | 32.0 | 7.5 | 15.8 | 30.5 | 43.4 |
| | | BRIEF | 7.7 | 17.7 | 30.5 | 6.6 | 16.3 | 29.3 | 44.5 |
| | 0.020" | FULL | 7.6 | 17.4 | 30.3 | 7.3 | 15.9 | 28.0 | 43.4 |
| | | BRIEF | 8.2 | 17.8 | 28.5 | 6.3 | 16.2 | 28.3 | 45.4 |

From Table III above, it can be seen that the longitudinal and transverse tensile properties of vanadium-containing Alloys B and C were superior to those measured from comparative Alloy A. The addition of vanadium appears to promote improved tensile properties in the same manner as non-homogenizing or fast heating to annealing temperature, but without the attendant coarseness of recrystallized grain size. The effect of sisting of 0.03 – 0.6% silicon, 0.03 – 0.7% iron, 0.03 – 1.5% manganese, 0.03 – 0.20% vanadium, up to 0.3% copper, up to 0.2% titanium, balance aluminum.

7. The article of claim 6 wherein said alloy comprises about 0.10 – 0.20% silicon, about 0.40 – 0.60% iron, about 0.10 – 0.20% copper, about 0.10 – 1.5% manganese, about 0.005 – 0.02% titanium and 0.03 – 0.12% - vanadium.

8. The article of claim 6 wherein said vanadium is retained in solid solution.

9. The article of claim 6 wherein said article is in the annealed condition.

10. The article of claim 6 wherein said article is in the annealed and cold worked condition.

11. A method for the preparation of wrought products possessing a fine recrystallized grain size which consists essentially of:

A. providing an aluminum base alloy consisting of 0.03 – 0.6% silicon, 0.03 – 0.7% iron, 0.03 – 1.5% manganese, 0.03 – 0.20% vanadium, up to 0.3% copper, up to 0.2% titanium, balance aluminum;

B. casting said alloy;

C. heating said alloy to a homogenizing temperature;

D. hot and cold working said alloy;

E. wherein said cold working is followed by at least one annealing treatment which does not require a high rate of heating to annealing temperature.

12. The method of claim 11 wherein said alloy comprises about 0.10 – 0.20% silicon, about 0.40 – 0.60% iron, about 0.10 – 0.20% copper, about 0.10 – 1.5% manganese, about 0.005 – 0.02% titanium and 0.03 – 0.12% vanadium.

13. The method of claim 11 wherein said hot working is commenced at a temperature ranging from about 850° – 950°F.

14. The method of claim 13 wherein said hot working is commenced at a temperature of about 900°F.

15. The method of claim 11 wherein said alloys are hot and cold worked by rolling.

16. The method of claim 11 wherein said cold working includes at least one interanneal.

17. The method of claim 11 wherein the heating of step C is conducted for no more than about four hours at a temperature of about 1100°F.

18. The method of claim 11 wherein said rate of heating in step E is no more than about 50°F/hour.

* * * * *